US006086700A

United States Patent [19]

Valentini et al.

[11] Patent Number: 6,086,700

[45] Date of Patent: Jul. 11, 2000

[54] TRANSPARENT MEDIA FOR PHASE CHANGE INK PRINTING

[75] Inventors: Jose Esteban Valentini; Richard Roy Jones; Jule William Thomas, Jr.; Bernard Allan Apple, all of Hendersonville; John Thomas Chandler, Brevard; Jose A. Siqueira, Flat Rock, all of N.C.

[73] Assignee: Agfa-Gevaert N.V., Mortsel, Belgium

[21] Appl. No.: 09/083,324

[22] Filed: May 22, 1998

Related U.S. Application Data

[63] Continuation-in-part of application No. 08/711,422, Sep. 5, 1996, Pat. No. 5,756,226.

[51] Int. Cl.[7] ..... B41M 5/025

[52] U.S. Cl. ..... 156/235; 347/105; 428/195; 428/331; 428/341; 428/478.2; 428/480; 428/500; 428/522; 428/913; 428/914

[58] Field of Search ..... 347/105; 428/195, 428/331, 480, 478.2, 411.1, 500, 522, 913, 914, 341; 156/235

[56] References Cited

U.S. PATENT DOCUMENTS

| | | | |
|---|---|---|---|
| 3,889,270 | 6/1975 | Hoffman et al. | 346/1 |
| 4,460,637 | 7/1984 | Miyanato et al. | 428/212 |
| 4,542,059 | 9/1985 | Toyonoh et al. | 346/135.1 |
| 4,592,951 | 6/1986 | Viola | 428/331 |
| 4,636,410 | 1/1987 | Aksyh et al. | 427/261 |
| 4,740,420 | 4/1988 | Akufsu et al. | 428/341 |
| 4,770,934 | 9/1988 | Yamasaki et al. | 428/331 |
| 5,202,205 | 4/1993 | Malhota | 428/331 |
| 5,276,468 | 1/1994 | Deus et al. | 346/140 R |
| 5,302,436 | 4/1994 | Miller | 428/500 |
| 5,397,619 | 3/1995 | Kuroyama et al. | 428/141 |
| 5,418,078 | 5/1995 | Desic et al. | 428/500 |
| 5,753,360 | 5/1998 | Jones et al. | 428/323 |
| 5,756,226 | 5/1998 | Valentini et al. | 428/704 |

FOREIGN PATENT DOCUMENTS

| | | |
|---|---|---|
| 0634287 | 1/1995 | European Pat. Off. . |
| 4 364 947 | 12/1992 | Japan . |
| 5 514 70 | 3/1993 | Japan . |
| 6 320 46 | 2/1994 | Japan . |
| 6 931 22 | 4/1994 | Japan . |
| 7 81 214 | 3/1995 | Japan . |

*Primary Examiner*—Bruce H. Hess
*Attorney, Agent, or Firm*—Joseph T. Guy, Jr.

[57] ABSTRACT

An improved transparent media for ink printing is described. The media is a phase change ink recording media comprising: a polyethylene terephthalate support; a 1–15 mg/dm$^2$ lower receptor layer coated on the support wherein the lower receptor layer comprises: silica with a particle size of no more than 0.3 $\mu$m and a polymer; wherein the total weight of the polymer and the silica is 82–97%, by weight, silica and 3–18%, by weight, polymer. The media also comprises an optional upper receptive layer comprising a matrix polymer, an inorganic particulate material and a soft polymer matrix.

5 Claims, No Drawings

TRANSPARENT MEDIA FOR PHASE CHANGE INK PRINTING

RELATED APPLICATION

This application is a continuation-in-part of U.S. patent application Ser. No. 08/711,422 filed Sep. 5, 1996, now U.S. Pat. No. 5,756,226, issued May 26, 1998.

FIELD OF INVENTION

The present invention is related to transparent media for ink printing. More specifically, this invention is related to a transparent media and a process for forming the media. The media has superior clarity, resistance to scratching and excellent adhesion to phase change inks.

BACKGROUND OF THE INVENTION

Transparent films which display information are widely used throughout many different industries and for many applications. Typically, a positive image is formed by placing an ink or pigment onto a transparent plastic sheet. The image is then displayed by projection or by light transmission.

Many methods are available for printing a positive image onto a transparent plastic sheet. Ink jet printers, and their associated ink formulations, are well advanced technically; and aqueous ink jet printers represent a respectable share of the total printing market. Aqueous ink jet printing is particularly advantageous for printing text or images where the printed area covers a small portion of the area of the transparent sheet. However, aqueous ink jet printing is less suitable for printing large areas of a transparent plastic sheet since a large volume of solvent must be removed from the media. The volume of solvent increases with image density which leads a skilled artisan away from ink jet printing for high optical density, large print area applications.

Phase change ink printing corrects many of the deficiencies of aqueous ink jet printing. A high optical density can be obtained and large areas can be printed without evaporation of solvent. The impact of phase change ink printing in the market place has been impeded due to the lack of a suitable transparent media. Media designed for use with aqueous or other solvent based ink jet printers is unsuitable due to the large coating weight of the ink receptive layer which is required to absorb the ink solvent. Furthermore, the coatings used for aqueous or solvent ink jet media do not provide adequate adhesion for the phase change ink composition. Thus, there is a need for a media which will take full advantage of the properties offered by phase change ink printing.

Compositions described in commonly assigned U.S. Pat. No. 5,756,226 demonstrate adequate performance when used with phase change ink jet printing methods. Improvements in ink adhesion are still desired to insure adequate adhesion between the ink and the media. An overcoat comprising a softer polymer mixture is demonstrated herein to provide superior adhesion.

Japanese unexamined Patent Appl. Kokai 6-32046 teaches the addition of up to 10%, by weight, of a zirconium compound to improve the print quality. Japanese unexamined Patent Application Kokai 4-364,947 utilizes $TiO_2$ in a similar manner. The transparency of the coated layer is compromised by the addition of zirconium or titanium solids rendering the film unsuitable for use as a transparent media. Japanese unexamined Patent Appl. Kokai 4-201,286 teaches media which is suitable for aqueous ink jet printing yet the surface is susceptible to scratching. High scratch susceptibility renders a media unacceptable for use in automatic printing devices and for high quality printing applications.

SUMMARY OF THE INVENTION

It is an object of the present invention to provide an improved media for use with phase change ink printing.

It is a particular object of the present invention to provide a media which has improved resistance to surface scratching and improved adhesion with phase change inks.

A particular advantage offered by the present invention is the clarity which can be obtained and the suitability for use as a transparency media. The present invention is superior for printing applications requiring high clarity in unprinted areas.

These and other advantages, as will be apparent from the teachings herein, is demonstrated in a phase change ink recording media comprising: a polyethylene terephthalate support; a 1–15 mg/dm$^2$ lower receptor layer coated on the support wherein the lower receptor layer comprises: silica; and at least one polymer chosen from a set consisting of polyvinyl alcohol, polyvinyl pyrrolidone, polyacrylamide, methylcellulose and gelatin; wherein a total weight of the polymer and the silica is 82–97%, by weight, silica and 3–18%, by weight, polymer; and an upper receptive layer coated on said lower receptor layer wherein said upper receptor layer comprises: 32–70%, by weight, matrix polymer; 15–62%, by weight, inorganic particulate material; and 5–53%, by weight, soft polymer mixture.

The advantages offered by the present invention are particularly well suited for use with phase change inks. The superiority of the media is demonstrated in a process for forming a printed image comprising the steps of:

i) heating a solid phase change ink to form a liquid phase change ink;

ii) applying the liquid phase change ink to a transfer surface in a pattern;

iii) cooling the liquid phase change ink on the transfer surface to form an image of the pattern;

iv) transferring the solid image to a receptor comprising:
- a 1–10 mil thick polyethylene terephthalate support; and
- a 1–15 mg/dm$^2$ lower receptor layer coated on the support wherein the lower receptor layer comprises:
- a fibrous, branched silica with a particle size of no more than 0.3 $\mu$m; and
- a polymer chosen from a set consisting of polyvinyl alcohol, polyacrylamide and gelatin; and v) fixing the solid image to the receptor.

A preferred method for forming a transparent recording material for phase change ink recording comprising the steps of: making an aqueous coating solution comprising: water; a binder composition comprising: at least one polymer chosen from a group consisting of polyvinyl alcohol, polyacrylamide, methyl cellulose, polyvinyl pyrrolidone and gelatin; and an inorganic particulate material with an average particle size of no more than 0.3 $\mu$m wherein the inorganic particulate material represents at least 82%, by weight, and no more than 97%, by weight, of a combined coating weight of the polymer and the inorganic particulate material taken together; wherein the aqueous coating solution has an ionic conductivity of no more than 0.6 mS at 25° C.; applying the coating solution to a polyethyleneterephthalate support in a sufficient amount that the inorganic particulate material and said polymer taken together weigh 1–15 mg/dm$^2$; removing the water from the coating solution.

DETAILED DESCRIPTION OF THE INVENTION

The inventive media comprises a support with a receptive layer coated thereon. The receptive layer preferably comprises a lower receptive layer coated on the support and an upper receptive layer coated on the lower receptive layer. Throughout the specification "lower receptive layer" refers to the layer closest to the support and "upper receptive layer" refers to the layer furthest from the support. "Receptive layer" refers to the layer which includes a lower receptive layer and optionally an upper receptive layer.

The lower receptive layer comprises a binder and an inorganic particulate material. The binder comprises at least one water soluble polymer. The prefered water soluble polymers are chosen based on low ionic content and the presence of groups capable of adhering to silica. The water soluble polymer is most preferably chosen from polyvinyl alcohol, acrylates, hydrolyzed polyacrylamide, methyl cellulose, polyvinyl pyrrolidone, gelatin and copolymers thereof. Copolymers and grafted polymers are suitable provided they are water soluble or water dispersable and dry to a clear coat. Particularly suitable copolymers comprise acrylic acid/vinyl pyrrolidone copolymers and urethane/acrylate copolymers. More preferably, the binder comprises at least one polymer chosen from a group consisting of polyvinyl alcohol, polyvinyl pyrrolidone and gelatin. Most preferably, the binder comprises polymerized monomer chosen from vinyl alcohol, acrylamide, vinyl pyrrolidone and combinations thereof.

Throughout the specification, percentages of lower receptive layer components will be presented based on the combined weight of the polymers and the inorganic particulate material only, unless otherwise stated.

The inorganic particulate material of the lower receptor layer represents at least 82%, by weight, and no more than 97%, by weight, of the total weight of the polymer and inorganic particulate material taken together. Above 97%, by weight, inorganic particulate material the scratch resistance of the film deteriorates to levels which are unacceptable for use in high quality printing. Below 82%, by weight, inorganic particulate material the adhesion between phase change inks and the surface of the substrate, as measured by the tape test, decreases to levels which are unacceptable. Preferably the inorganic particulate material represents at least 89% and no more than 95% of the total weight of the polymer and inorganic particulate material taken together. Most preferably the inorganic particulate material represents 90–95% of the total weight of the polymer and inorganic particulate material taken together.

Average particle size is determined as the hydrodynamic particle size in water and is the size of a spherical particle with the same hydrodynamic properties as the sample in question. By way of example, a fibrous silica particle with actual dimensions on the order of 0.150 $\mu$m by 0.014 $\mu$m has a hydrodynamic particle size of approximately 0.035 $\mu$m.

The degree of ionization of silica plays an important role in the degree of ionization of the coating solution. The degree of ionization of the coating solution has been determined to play a major role in the clarity of the final media. The degree of ionization can be measured as the ionic strength of the coating formulation which is determined from the ionic conductivity of the coating solution prior to application on the support. Preferred is a total coating solution ionic conductivity of no more than 0.6 mS (Siemens×10$^3$) as measured at 25° C. at 10%, by weight, total solids, on a properly standardized EC Meter Model 19101-00 available from Cole-Parmer Instrument Company of Chicago Ill., USA. More preferred is an ionic conductivity of no more than 0.5 mS, when measured at 25° C. at 10%, by weight, total solids. Most preferred is an ionic conductivity of no more than 0.3 mS, when measured at 25° C. at 10%, by weight, total solids.

The coating weight of the inorganic particulate material and the polymer is preferably at least 1 mg/dm$^2$ and no more than 15 mg/dm$^2$ per side for the lower receptive layer. Above 15 mg/dm$^2$ the scratch resistance decreases to unacceptable levels for high quality printing. Below 1 mg/dm$^2$ phase change inks adhesion to the coating decreases to unacceptable levels and the the coating quality diminishes requiring either decreased production rates or increases in the amount of unusable material both of which increase the cost of manufacture for the media. More preferably, the coating weight of the inorganic particulate material and the polymer is no more than 8 mg/dm$^2$ and most preferably the coating weight is no more than 5 mg/dm$^2$.

The upper receptive layer is coated supra the lower receptive layer. Intervening layers may be employed if desired for convenience, however, their use is not required to realize the advantage of the present invention.

The dried coating weight of the upper receptive layer is preferably 1–6 mg/dm$^2$. More preferably the dried coating weight of the upper receptive layer is 3–5 mg/dm$^2$. Most preferably the dried coating weight of the upper receptive layer is approximately 4 mg/dm$^2$.

The coating composition for the upper receptive layer comprises a matrix polymer, an inorganic particulate material and a soft polymer mixture.

The upper receptive layer preferably comprises 32–70%, by weight, matrix polymer; 15–62%, by weight, inorganic particulate material and 5–15%, by weight, soft polymer mixture. More preferably, the upper receptive layer preferably comprises 40–70%, by weight, matrix polymer and more preferably 60–65%, by weight matrix polymer. Preferably, the upper receptive layer comprises 15–35%, by weight, inorganic particulate material and more preferably 20–30%, by weight, inorganic particulate material. Preferably, the upper receptive layer comprises 10–15%, by weight, soft polymer mixture.

The preferred matrix polymer is chosen from polyvinyl alcohol, acrylates, hydrolyzed polyacrylamide, methyl cellulose, polyvinyl pyrrolidone, gelatin and copolymers thereof. Copolymers and grafted polymers are suitable provided they are water soluble or water dispersable and dry to a clear coat. Particularly suitable copolymers comprise acrylic acid/vinyl pyrrolidone copolymers and urethane/acrylate copolymers. More preferably, the matrix polymer comprises at least one polymer chosen from a group consisting of polyvinyl alcohol, polyvinyl pyrrolidone and gelatin. Most preferably, the matrix polymer comprises polymerized monomer chosen from vinyl alcohol, acrylamide, vinyl pyrrolidone and combinations thereof. Polyvinyl alcohol is the most preferred matrix polymer.

The soft polymer mixture improves adhesion between the phase change ink and the upper receptive layer.

The term "soft polymer mixture" describes a polymer, or mixture of polymers that soften during the image transfer step of phase change ink printing. The softening allows the phase change ink and receptive layer to become chemically or physically mated for superior durability. The soft polymer matrix must be sufficiently soft to allow the ink and coating to become intimately interrelated and yet rigid enough to avoid scratching and sticking with adjoining films.

The prefered soft polymer mixture comprises methyl acrylate, acrylic acid and sodium acrylate. Preferably, the soft polymer mixture comprises methyl acrylate representing 2–24%, by weight, of the upper receptive layer; acrylic acid representing 1–10%, by weight, of the upper receptive layer; and sodium acrylate representing 1–19%, by weight, of the upper receptive layer. More preferably, the soft polymer mixture comprises methyl acrylate representing 5–6%, by weight, of the upper receptive layer; acrylic acid representing 3–4%, by weight, of the upper receptive layer and sodium acrylate representing 4–5%, by weight, of the upper receptive layer.

It is optional, but preferable, to incorporate large particles in the upper receptive layer to increase surface area. Large particles are defined as nonreactive particles over 6 $\mu$m in size with preferred large particles being no more than 10 $\mu$m in size. The most preferred large particle are chosen from polymethylmethacrylate beads, styrene beads, glass beads, teflon beads, and the like. It is preferable that the large particles be added in an amount sufficient to provide approximately 10–80 particles per 5000 $\mu m^2$ of coated material. More preferably the large particles are added in an amount sufficient to provide 40–60 particles per 5000 $\mu m^2$ of coated material.

The inorganic particulate material is preferably chosen from a set consisting of colloidal silica and alumina. The preferred inorganic particulate material is colloidal silica with an average particle size of no more than 0.3 $\mu$m. More preferably the inorganic particulate material is colloidal silica with an average particle size of no more than 0.1 $\mu$m. Most preferably the inorganic particulate material is colloidal silica with an average particle size of no more than about 0.03 $\mu$m. The average particle size of the colloidal silica is preferably at least 0.005 $\mu$m. A particularly preferred colloidal silica is a multispherically coupled and/or branched form, also referred to as fibrous, branched silica. Specific examples include colloidal silica particles having a long chain structure in which spherical colloidal silica is coupled in a multispherical form, and the colloidal silica in which the coupled silica is branched. The coupled colloidal silica is obtained by forming particle-particle bonds between primary particles of spherical silica. The particle-particle bonds are formed with metallic ions having a valence of two or more interspersed between the primary particles of spherical silica. Preferred is a colloidal silica in which at least three particles are coupled together. More preferably at least five particles are coupled together and most preferably at least seven particles are coupled together.

It is preferable to add a cross linker to the receptive layer to increase the strength of the dried coating. Preferred cross linkers are siloxane or silica silanols. Particularly suitable hardeners are defined by the formula, $R^1_nSi(OR^2)_{4-n}$ where $R^1$ is an alkyl, or substituted alkyl, of 1 to 18 carbons; $R^2$ is hydrogen, or an alkyl, or substituted alkyl, of 1 to 18 carbons; and n is an integer of 1 or 2. Aldehyde hardeners such as formaldehyde or glutaraldehyde are suitable hardeners. Pyridinium based hardeners such as those described in, for example, U.S. Pat. Nos. 3,880,665, 4,418,142, 4,063, 952 and 4,014,86; imidazolium hardeners as defined U.S. Pat. No. 5,459,029; U.S. Pat. No. 5,378,842; U.S. patent application Ser. No. 08/463,793 filed Jun. 5, 1995 (IM-0963B), and U.S. patent application Ser. No. 08/401,057 filed Mar. 8, 1995 (IM-0937) are suitable for use in the present invention. Aziridenes and epoxides are also effective hardeners.

Crosslinking is well known in the art to form intermolecular bonds between various molecules and surfaces thereby forming a network. In the instant invention a crosslinker may be chosen to form intermolecular bonds between pairs of water soluble polymers, between pairs of water insoluble polymers, or between water soluble polymers and water insoluble polymers. If crosslinking is applied it is most preferable to crosslink the polymers to the inorganic particulate matter. It is preferable to apply any crosslinking additive just prior to or during coating. It is contemplated that the crosslinking may occur prior to formation of the coating solution or in situ.

The term "gelatin" as used herein refers to the protein substances which are derived from collagen. In the context of the present invention "gelatin" also refers to substantially equivalent substances such as synthetic derivatives of gelatin. Generally gelatin is classified as alkaline gelatin, acidic gelatin or enzymatic gelatin. Alkaline gelatin is obtained from the treatment of collagen with a base such as calcium hydroxide, for example. Acidic gelatin is that which is obtained from the treatment of collagen in acid such as, for example, hydrochloric acid. Enzymatic gelatin is generated by a hydrolase treatment of collagen. The teachings of the present invention are not restricted to gelatin type or the molecular weight of the gelatin. Carboxyl-containing and amine containing polymers, or copolymers, can be modified to lessen water absorption without degrading the desirable properties associated with such polymers and copolymers.

Other materials can be added to the receptive layer to aid in coating and to alter the rheological properties of either the coating solution or the dried layer. Polymethylmethacrylate beads can be added to assist with transport through phase change ink printers. Care must be taken to insure that the amount of beads is maintained at a low enough level to insure that adhesion of the phase change ink to the substrate and the high clarity is not deteriorated. It is conventional to add surfactants to a coating solution to improve the coating quality. Surfactants and conventional coating aids are compatible with the present invention.

The preferred support is a polyester obtained from the condensation polymerization of a diol and a dicarboxylic acid. Preferred dicarboxylic acids include terephthalate acid, isophthalic acid, phthalic acid, naphthalenedicarboxylic acid, adipic acid and sebacic acid. Preferred diols include ethylene glycol, trimethylene glycol, tetramethylene glycol and cyclohexanedimethanol. Specific polyesters suitable for use in the present invention are polyethylene terephthalate, polyethylene-p-hydroxybenzoate, poly-1,4-cyclohexylene dimethylene terephthalate, and polyethylene-2,6-naphthalenecarboyxlate. Polyethylene terephthalate is the most preferred polyester for the support due to superior water resistance, chemical resistance and durability. The polyester support is preferably 1–10 mil in thickness. More preferably the polyester support is 3–8 mil thick and most preferably the polyester support is either 3.5–4.5 mil or 6–8 mil thick.

A primer layer is preferably included between the ink receptor layer and the support to improve adhesion therebetween. Preferred primer layers are resin layers or antistatic layers. Resin and antistatic primer layers are described in U.S. Pat. Nos. 3,567,452; 4,916,011; 4,701,403; 4,891,308; 4,225,665, 5,554,447.

The primer layer is typically applied, and dry-cured during the manufacture of the polyester support. When polyethylene terephthalate is manufactured for use as a photographic support, the polymer is cast as a film, the mixed polymer primer layer composition is applied to one or both sides and the structure which is then biaxially stretched. The biaxial stretching is optionally followed by coating of a gelatin subbing layer. Upon completion of stretching and the application of the subbing layer compositions, it is necessary to remove strain and tension in the support by a heat treatment comparable to the annealing of glass. Air temperatures of from 100° C. to 160° C. are typically used for this heat treatment.

It is prefered to activate the surface of the support prior to coating to improve the coating quality thereon. The activation can be accomplished by corona-discharge, glow-discharge, UV-rays or flame treatment. Corona-discharge is preferred and can be carried out to apply an energy of 1 mw to 1 kw/$m^2$. More preferred is an energy of 0.1 w to 5 w/$m^2$.

Bactericides may be added to any of the described layers to prevent bacteria growth. Preferred are Kathon®, neomycin sulfate, and others as known in the art.

An optional, but preferred backing layer can be added to decrease curl, impart color, assist in transport, and other properties as common to the art. Aforementioned antistatic layers are suitable as backing layers. The backing layer may comprise cross linkers to assist in the formation of a stronger matrix. Preferred cross linkers are carboxyl activating agents as defined in Weatherill, U.S. Pat. No. 5,391,477. Most preferred are imidazolium hardeners as defined in Fodor, et al, U.S. Pat. No. 5,459,029; U.S. Pat. No. 5,378,842; U.S. Pat. No. 5,591,863; U.S. Pat. No. 5,601,971. The backing layer may also comprise transport beads such as polymethylmethacrylate. It is known in the art to add various surfactants to improve coating quality. Such teachings are relevant to the backing layer of the present invention.

Phase change inks are characterized, in part, by their propensity to remain in the solid phase at ambient temperature and in the liquid phase at elevated temperatures in the printing head. The ink is heated to form the liquid phase and droplets of liquid ink are ejected from the printing head onto an optional transfer surface. The transfer surface is maintained at a temperature which is suitable for maintaining the phase change ink in a rubbery state. The ink droplets are then transferred to the surface of the printing media maintained at 20–35° C. wherein the phase change ink solidifies to form a pattern of solid ink drops.

Exemplary phase change ink compositions comprise the combination of a phase change ink carrier and a compatible colorant.

Exemplary phase change ink colorants comprise a phase change ink soluble complex of (a) a tertiary alkyl primary amine and (b) dye chromophores having at least one pendant acid functional group in the free acid form. Each of the dye chromophores employed in producing the phase change ink colorants are characterized as follows: (1) the unmodified counterpart dye chromophores employed in the formation of the chemical modified dye chromophores have limited solubility in the phase change ink carrier compositions, (2) the chemically modified dye chromophores have at least one free acid group, and (3) the chemically modified dye chromophores form phase change ink soluble complexes with tertiary alkyl primary amines. For example, the modified phase change ink colorants can be produced from unmodified dye chromophores such as the class of Color Index dyes referred to as Acid and Direct dyes. These unmodified dye chromophores have limited solubility in the phase change ink carrier so that insufficient color is produced from inks made from these carriers. The modified dye chromophore preferably comprises a free acid derivative of a xanthene dye.

The tertiary alkyl primary amine typically includes alkyl groups having a total of 12 to 22 carbon atoms, and preferably from 12 to 14 carbon atoms. The tertiary alkyl primary amines of particular interest are produced by Rohm and Haas Texas, Incorporated of Houston, Tex. under the tradenames Primene JMT and Primene 81-R. Primene 81-R is a particularly suitable material. The tertiary alkyl primary amine of this invention comprises a composition represented by the structural formula:

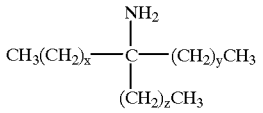

wherein:

x is an integer of from 0 to 18;

y is an integer of from 0 to 18; and z is an integer of from 0 to 18;

with the proviso that the integers x, y and z are chosen according to the relationship:

$$x+y+z=8 \text{ to } 18.$$

An exemplary phase change ink carrier comprises a fatty amide containing material. The fatty amide-containing material of the phase change ink carrier composition may comprise a tetraamide compound. Particularly suitable tetra-amide compounds for producing phase change ink carrier compositions are dimeric acid-based tetra-amides including the reaction product of a fatty acid, a diamine such as ethylene diamine and a dimer acid. Fatty acids having from 10 to 22 carbon atoms are suitable in the formation of the dimer acid-based tetra-amide. These dimer acid-based tetramides are produced by Union Camp and comprise the reaction product of ethylene diamine, dimer acid, and a fatty acid chosen from decanoic acid, myristic acid, stearic acid and docosanic acid. Dimer acid-based tetraamide is the reaction product of dimer acid, ethylene diamine and stearic acid in a stoichiometric ratio of 1:2:2, respectively. Stearic acid is a particularly suitable fatty acid reactant because its adduct with dimer acid and ethylene diamine has the lowest viscosity of the dimer acid-based tetra-amides.

The fatty amide-containing material can also comprise a mono-amide. The phase change ink carrier composition may comprise both a tetra-amide compound and a mono-amide compound. The mono-amide compound typically comprises either a primary or secondary mono-amide. Of the primary mono-amides stearamide, such as Kemamide S, manufactured by Witco Chemical Company, can be employed herein. The mono-amides behenyl behemamide and stearyl stearamide are extremely useful secondary mono-amides. Stearyl stearamide is the mono-amide of choice in producing a phase change ink carrier composition.

Another way of describing the secondary mono-amide compound is by structural formula. More specifically, the secondary mono-amide compound is represented by the structural formula:

$$C_xH_y—CO—NHC_aH_b$$

wherein:

x is an integer from 5 to 21;

y is an integer from 11 to 43;

a is an integer from 6 to 22; and b is an integer from 13 to 45.

The fatty amide-containing compounds comprise a plurality of fatty amide materials which are physically compatible with each other. Typically, even when a plurality of fatty amide-containing compounds are employed to produce the phase change ink carrier composition, the carrier composition has a substantially single melting point transition. The melting point of the phase change ink carrier composition is most suitably at least about 70° C.

The phase change ink carrier composition may comprise a tetra-amide and a mono-amide. The weight ratio of the tetra-amide to the mono-amide is from about 2:1 to 1:10.

Modifiers such as tackifiers and plasticizers may be added to the carrier composition to increase the flexibility and adhesion. The tackifiers of choice are compatible with fatty amide-containing materials. These include, for example, Foral 85, a glycerol ester of hydrogenated abietic acid, and Foral 105, a pentaerythritol ester of hydroabietic acid, both manufactured by Hercules Chemical Company; Nevtac 100 and Nevtac 80 which are synthetic polyterpene resins manufactured by Neville Chemical Company; Wingtack 86, a modified synthetic polyterpene resin manufactured by Goodyear Chemical Company, and Arakawa KE 311, a rosin ester manufactured by Arakawa Chemical Company. Arakawa KE 311, is a particularly suitiable tackifier for use phase change ink carrier compositions.

Plasticizers may be added to the phase change ink carrier to increase flexibility and lower melt viscosity. Plasticizers which have been found to be advantageous in the composition include dioctyl phthalate, diundecyl phthalate, alkylbenzyl phthalate (Santicizer 278) and triphenyl phosphate, all manufactured by Monsanto Chemical Company; tributoxyethyl phosphate (KP-140) manufactured by FMC Corporation; dicyclohexyl phthalate (Morflex 150) manufactured by Morflex Chemical Company Inc.; and trioctyl trimellitate, manufactured by Kodak. However, Santicizer 278 is a plasticizer of choice in producing the phase change ink carrier composition.

Other materials may be added to the phase change ink carrier composition. In a typical phase change ink carrier composition antioxidants are added for preventing discoloration. Antioxidants include Irganox 1010, manufactured by Ciba Geigy, Naugard 76, Naugard 512, and Naugard 524, all manufactured by Uniroyal Chemical Company.

A particularly suitable phase change ink carrier composition comprises a tetra-amide and a mono-amide compound, a tackifier, a plasticizer, and a viscosity modifying agent. The compositional ranges of this phase change ink carrier composition are typically as follows: from about 10 to 50 weight percent of a tetraamide compound, from about 30 to 80 weight percent of a mono-amide compound, from about 0 to 25 weight percent of a tackifier, from about 0 to 25 weight percent of a plasticizer, and from about 0 to 10 weight percent of a viscosity modifying agent.

A phase change ink printed substrate is typically produced in a drop-on-demand ink jet printer. The phase change ink is applied to at least one surface of the substrate in the form of a predetermined pattern of solidified drops. The application of phase change ink preferably involves a transfer. Upon contacting the substrate surface, the phase change ink solidifies and adheres to the substrate. Each drop on the substrate surface is non-uniform in thickness and transmits light in a non-rectilinear path.

The pattern of solidified phase change ink drops can, however, be reoriented to produce a light-transmissive phase change ink film on the substrate which has a high degree of lightness and chroma, when measured with a transmission spectrophotometer, and which transmits light in a substantially rectilinear path. The reorientation step involves the controlled formation of a phase change ink layer of a substantially uniform thickness. After reorientation, the layer of light-transmissive ink will transmit light in a substantially rectilinear path.

The transmission spectra for each of the phase change inks can be evaluated on a commercially available spectrophotometer, the ACS Spectro-Sensor II, in accordance with the measuring methods stipulated in ASTM E805 (Standard Practice of Instrumental Methods of Color or Color Difference Measurements of Materials) using the appropriate calibration standards supplied by the instrument manufacturer. For purposes of verifying and quantifying the overall calorimetric performance, measurement data are reduced, via tristimulus integration, following ASTM E308 (Standard Method for Computing the Colors of Objects using the CIE System) in order to calculate the 1976 CIE L* (Lightness), a* (redness-greeness), and b* (yellownessblueness), (CIELAB) values for each phase change ink sample. In addition, the values for CIELAB Psychometric Chroma, C* sub ab, and CIELAB Psychometric Hue Angle, h sub ab were calculated according to publication CIE 15.2, Colorimetry (Second Edition, Central Bureau de la CIE, Vienna, 1986).

The nature of the phase change ink carrier composition is chosen such that thin films of substantially uniform thickness exhibit a relatively high L* value. For example, a substantially uniform thin film of about 20–70 $\mu$m thickness of the phase change ink carrier preferably has an L* value of at least about 65.

The phase change ink carrier composition forms an ink by combining the same with a colorant. A subtractive primary colored phase change ink set will be formed by combining the ink carrier composition with compatible subtractive primary colorants. The subtractive primary colored phase change inks comprise four component dyes, namely, cyan, magenta, yellow and black. The subtractive primary colorants comprise dyes from either class of Color Index (C.I.) Solvent Dyes and Disperse Dyes. Employment of some C.I. Basic Dyes can also be successful by generating, in essence, an in situ Solvent Dye by the addition of an equimolar amount of sodium stearate with the Basic Dye to the phase change ink carrier composition. Acid Dyes and Direct Dyes are also compatible to a certain extent.

The phase change inks formed therefrom have, in addition to a relatively high L* value, a relatively high $C^*_{ab}$ value when measured as a thin layer of substantially uniform thickness as applied to a substrate. A reoriented layer of the phase change ink composition on a substrate has a $C^*_{ab}$ value, as a substantially uniform thin film of about 20 $\mu$m thickness, of subtractive primary yellow, magenta and cyan phase change ink compositions, which are at least about 40 for yellow ink compositions, at least about 65 for magenta ink compositions, and at least about 30 for cyan ink compositions.

Tape test density is a quantitative measurement indicating the propensity of the phase change ink to remain adhered to the media. The tape test is performed by adhering, using a 10 lb. roller weight, at least 10 cm of 3M Scotch Type 810 Magic Tape (19 mm wide) to cover all of a strip of a 5 cm×5 cm square, maximum black density (Tektronix 016-1307-00 black wax) single layer wax ink crosshatched pattern (with 5 mm spaced 0.2 mm lines without ink) printed on the media using a Tektronix Phaser 340 in the paper mode at 300×600 dpi, (monochrome) leaving approximately 1 cm of tape unattached. By grasping the unattached tape tag, the tape is pulled off of the media and printed area in one single rapid motion. The density of the peeled (Tp) and the original inked (To) areas on the media are measured using a Macbeth TR927 densitometer zeroed with the clear filter and using the "density" selection taking care to center the Macbeth spot in a single 5 mm×5 mm crosshatched square. A higher tape test density is preferred since this indicates a smaller percentage of phase change ink removal. No removal of phase change ink would be indicated by a tape test density of 100. Complete removal of the phase change ink would be indicated by a tape test density of 0. Tape test values are typically reproducible to a standard deviation of no larger than 5%. The tape test density is the loss of transmittance according to the following formula:

$$TT = \frac{(100 - \%\,Tp)}{(100 - \%\,To)} \times 100$$

where TT is relative tape test density retained; Tp is % transmittance of the area after the tape is peeled off; and To is % transmittance of the original inked area.

The relative tape test density retained following the tape test decreases with the age of both the media and the printed area. The decrease is typically 10% of the initial value obtained with a fresh printing on a one-day old coating when remeasured after several months. Tape test densities reported herein are for fresh printings on one month old coatings.

The scratch resistance of coated media is measured by the use of the ANSI PH1.37-1977(R1989) method for determination of the dry scratch resistance of photographic film. The device used is described in the ANSI IT9.14-1992 method for wet scratch resistance. Brass weights up to 900 g. in the continuous loading mode are used to bear on a spherical sapphire stylus of 0.38 mm radius of curvature, allowing an estimated maximum loading of 300 kgm/cm$^2$. Since the stylus is a constant, the results can be reported in gram mass required to initiate and propagate a scratch, as viewed in reflected light. Scratch data is typically accurate to within approximately 50 gms.

Total haze of the coated media is measured with a Gardner XL-211 Hazegard System calibrated to 1, 5, 10, 20 and 30% haze NIST standards (standard deviation 0.02) on 35 mm wide strips held 1.2 cm from the transmission entrance on the flat surface of a quartz cell. The measured scattered light (TH) and the 100% scatter transmitted light reference (% REF) with the 100% diffuser in place are recorded. The result is reported as % TH=100×TH/% REF. The internal haze is measured similarly by immersing the strip into light mineral oil (Fisher 0121-1) in the quartz cell with the sample at the far face of the cell (closest to the position described above). The close index of refraction match of the mineral oil to the media allows assessment of the scattering arising from within the coating and polyester base. The difference between these two measures of haze is largely due to the roughness of the coated surface. The haze was observed to be essentially independent of sample age, temperature or room humidity below 50% relative humidity.

Tape adhesion is a quantitative measurement indicating the propensity of the phase change ink to remain adhered to the media. The tape adhesion test is performed by adhering a 20 cm. strip of 3M Scotch Tape type 810 Magic Tape along the upper edge of a 3" by 8" black image printed with a Tektronix Phaser 340 in the manual transparency mode. By grasping the unattached tape tag, the tape is pulled off of the media and the density of the ink remaining on the tape is measured. The density on the tape is measured in a manner analogous to the one described above for the test test density where the density remaining on the film is measured. A tape adhesion scale is used for comparison wherein:

a density of 0 to 0.25 is rated 4, a density of 0.25 to 0.5 is rated 3, a density of 0.5 to 0.75 is rated 2, a density of 0.75 to 1.0 is rated 1, a density of 1.0 to 1.2 is rated 0.

Impact represents a measure of the adhesion of the phase change ink under conditions of rapid delamination with higher numbers being preferred. Impact is measured by a Gardner Impact Tester (Cat No. 1G1121) from BYK Gardner, Silver Spring, Md. The tester is modified by placing a rubber stopper in the drilled out anvil to a position slightly above being flush with the top of the anvil. This is done so as to avoid gross distortions of the PET base film upon impact by the hammer. The weight used to deliver the hammer blow is the 85 gm weight available from BYK Gardner. A specially modified Tektronix Phaser 340 is used to deliver in one media pass a double layer of black ink uniformly to a 10 cm×19 cm area and after waiting for at least five minutes for the wax layer to come to room temperature, impacts are delivered from a height of 10 cm to each of four spots on a line parallel to the leading edge of the printed sheet on the side opposite the wax. One impact is delivered in the first spot, two in the second in succession, and so on up to a maximum of four impacts in the fourth spot. After impacting, Scotch Magic(TM) Tape (type 810) form 3M Company, St. Paul Minn. is applied over the impacted spots and slowly removed to lift any dislodged ink. The sample is then rated on a scale of 0 to 4 depending on the number of impacts required to dislodge ink from the impacted area. The following definition of grades were used:

| Grade | Appearance |
|---|---|
| 0 | Significant ink dislodged in one hammer blow with complete removal with two or more blows |
| 1 | No or very little ink removed in one blow, significant ink dislodged in two blows, and complete removal with three or more blows |
| 2 | No or very little ink removed in one or two blows, significant ink dislodged in three blows, and complete removal with four blows |
| 3 | No or very little in removed with one, two or three blows, significant ink dislodged with four blows |
| 4 | No or very little ink removed using up to four consecutive blows |

The judgment of how much ink removal is considered "very little" is made by a comparison to a region which has not been impacted but has had the tape applied and removed.

The following examples are illustrative of the invention and are not intended to limit the invention in any manner.

EXAMPLE 1

Preparation of Coating Solutions

The polymer solution was prepared in a jacketed, stirred container at about 7–8 wt %. The polymer, typically available as a powder, was dispersed at moderately high shear in deionized water for a short duration. The shear was increased, the temperature raised to above 90° C., and the temperature maintained until the polymer was completely dissolved (approximately ½ hour). The solution was cooled to 25–30° C., and the weight percent solids determined. pH was adjusted to closely approximate that of the inorganic particulate material. Coating aids such as Triton X-100, ethyl alcohol, antimicrobials, Teflon beads and other additives can be added if desired. A solution containing the inorganic particulate matter was prepared in a separate, stirred container. The polymer solution and inorganic particulate matter solution were then combined and analyzed to insure that pH, viscosity were suitable for coating. The mixtures were coated within 24 hours of their preparation.

Various coating solutions were prepared as detailed above with the silica types and percentages as shown in Table 1. Conductivity (Con.) was determined in millisiemens (mS) as described previously for the coating solution at 25° C. corrected to 10%, by weight, solids. Percent total haze (% TH) was measured by the procedure described previously and the results were normalized to 10 mg/dm$^2$ coating weight. The results are recorded in Table 1.

TABLE 1

| Sample | Silica | PS | % Si | pH | % TH | Con. | |
|---|---|---|---|---|---|---|---|
| C-1 | CL | 0.012 | 97 | 3.7 | 103 | 1.63 | Comp. |
| C-2 | CL | 0.012 | 96 | 3.6 | 76 | 1.61 | Comp. |
| C-3 | SK | 0.012 | 87 | 4.3 | 95 | 0.92 | Comp. |
| C-4 | SK | 0.012 | 82 | 4.2 | 65 | 0.87 | Comp. |
| C-5 | SKB | 0.012 | 87 | 4.3 | 55.8 | 0.76 | Comp. |
| C-6 | TM50 | 0.022 | 95 | 9.6 | 59 | 0.75 | Comp. |
| C-7 | TM50 | 0.022 | 93 | 8.8 | 98 | 0.73 | Comp. |
| C-8 | SKB | 0.012 | 82 | 4.2 | 44 | 0.72 | Comp. |
| C-9 | LS | 0.012 | 97 | 8.6 | 10 | 0.66 | Comp. |
| C-10 | LS | 0.012 | 96 | 8.1 | 13 | 0.65 | Comp. |
| I-1 | TMA | 0.022 | 87 | 4.1 | 2.8 | 0.56 | Inv. |
| I-2 | TMA | 0.022 | 82 | 3.8 | 4.0 | 0.53 | Inv. |
| I-3 | OUP | 0.035 | 82 | 3.9 | 2.4 | 0.38 | Inv. |
| I-4 | OUP | 0.035 | 85 | 4 | 1.9 | 0.34 | Inv. |
| I-5 | OUP | 0.035 | 84 | 3.6 | 2.0 | 0.33 | Inv. |
| I-6 | OUP | 0.035 | 87 | 4.2 | 1.6 | 0.29 | Inv. |
| I-7 | OUP | 0.035 | 87 | 3.8 | 2.38 | 0.29 | Inv. |
| I-8 | OUP | 0.035 | 87 | 4.3 | 1.23 | 0.29 | Inv. |
| I-9 | OUP | 0.035 | 87 | 4 | 1.12 | 0.29 | Inv. |

where:

PS is particle size in $\mu$m; % Si is the percent, by weight, of silica as a fraction of the total weight of silica and polymer; mS is the conductivity at 25° C. at 10% solids, by weight; CL is Ludox CL available from E. I. duPont de Nemours & Co. of Wilmington, Del. USA; SK is Ludox SK available from E. I. duPont de Nemours & Co. of Wilmington, Del. USA; SKB is Ludox SKB available from E. I. duPont de Nemours & Co. of Wilmington, Del. USA; TM-50 is Ludox TM-50 available from E. I. duPont de Nemours & Co. of Wilmington, Del. USA; LS is Ludox LS available from E. I. duPont de Nemours & Co. of Wilmington, Del. USA; TMA is Ludox TMA available from E. I. duPont de Nemours & Co. of Wilmington, Del. USA; and OUP is Snowtex-OUP available from Nissan Chemical Industry, Ltd. Tokyo, Japan.

The results presented in Table 1 indicate a significant reduction in total haze for samples with a conductivity of less than 0.6 mS. Total haze is shown to be essentially independent of particle size or pH within the ranges illustrated.

EXAMPLE 2

Samples were prepared using the coating solution of Example 1 as the only receptive layer. The inorganic particulate material represented 88%, by weight, of the weight of the particulate material and polymer taken together. Triton X-100 and Teflon beads were added at levels of $5\times10^{-3}$% and 0.4%, respectively, by weight, based on the weight of the total coating solution. Thickness was determined based on coating weight and known density of the dried coating. Scratch resistance was determined as described previously. The results are provided in Table 2.

TABLE 2

| Sample | CW | Thick | Scr | |
|---|---|---|---|---|
| C-11 | 33 | 1.65 | 300 | Comp. |
| C-12 | 21 | 1.05 | 250 | Comp. |
| C-13 | 16 | 0.8 | 310 | Comp. |
| I-10 | 12 | 0.6 | 425 | Inv. |
| I-11 | 10 | 0.5 | 375 | Inv. |
| I-12 | 10 | 0.5 | 320 | Inv. |
| I-13 | 8 | 0.4 | 350 | Inv. |
| I-14 | 4 | 0.2 | 500 | Inv. |

Wherein:

CW is coating weight in mg/dm2.

Thick is thickness of the coated layer in $\mu$m calculated assuming a dried solids density of 2.0 gm/cc.

Scr is the weight, in grams, required to initiate and propagate a scratch.

The results of Example 2 illustrate increased scratching observed for samples with a coating weight of greater than 15 mg/dm2.

EXAMPLE 3

Samples were prepared as described above for Example 2 using Nissan-OUP silica with 0.49%, by weight, Triton X-100 added to the coating solution. A phase change ink image was printed on the media as described and the adhesion of the phase change ink to the media was determined by the tape test. Tape test density was determined as described previously. The results are provided in Table 3. Each analysis represents the average of four independent measurements.

TABLE 3

| Sample | % Si | TT | |
|---|---|---|---|
| I-15 | 87 | 75 | Inv. |
| I-16 | 85 | 75 | Inv. |
| I-17 | 82 | 78 | Inv. |
| C-14 | 77 | 70 | Comp. |

Wherein % Si is the percentage of polymer and silica represented by silica; TT is tape test density.

The results of Example 3 illustrate that the adhesion between the inventive media and the phase change ink is superior to the comparative examples.

EXAMPLE 4

A coating composition was prepared as described in Example 1 with 88%, by weight, silica and 12%, by weight polyvinylalcohol for use as the lower receptive layer. A coating weight of 5 mg/dm$^2$ was used for the lower receptive layer. Coating compositions for an upper receptive layer were prepared comprising the approximate compositions in Table 4 coated at approximately 4 mg/dm$^2$. The soft polymer mixture comprises methyl acrylate, acrylic acid and sodium acrylate.

TABLE 4

| Sample | PVA | Silica | MA | AA | SA |
|---|---|---|---|---|---|
| I-18 | 62 | 25 | 5.5 | 3.3 | 4.4 |
| I-19 | 45.5 | 44.5 | 4.2 | 2.5 | 3.3 |

TABLE 4-continued

| Sample | PVA | Silica | MA | AA | SA |
|---|---|---|---|---|---|
| I-20 | 37.9 | 36.9 | 10.3 | 6.3 | 8.3 |
| I-21 | 30.3 | 29.4 | 16.7 | 10.1 | 13.3 |
| I-22 | 21.6 | 21.0 | 23.8 | 14.4 | 18.9 |
| I-23 | 61.7 | 24.6 | 5.5 | 3.3 | 4.5 |
| I-24 | 45.0 | 45.0 | 4.1 | 2.5 | 3.3 |
| I-25 | 31 | 62 | 2.9 | 1.7 | 2.2 |
| I-26 | 23.7 | 71.0 | 2.2 | 1.3 | 1.7 |
| I-27 | 12 | 88 | — | — | — |

PVA is polyvinyl alcohol with a molecular weight of -50, 000, MA is methyl acrylate, AA is acrylic acid, and SA is sodium acrylate. Sample I-27 is the lower receptive layer without an upper receptive layer.

The samples were subjected to tape density test and adhesion test as describe previously. The results are provided in Table 5.

TABLE 5

| Sample | TA | AT |
|---|---|---|
| I-18 | 3 | 4 |
| I-19 | 3 | 4 |
| I-20 | 2–3 | 4 |
| I-21 | 0 | 1 |
| I-22 | 0 | 1 |
| I-23 | 3 | 4 |
| I-24 | 3 | 2 |
| I-25 | 3 | 2 |
| I-26 | 0 | 1 |
| I-27 | 0 | 1 |

Where TA is the tape adhesion test, AT is adhesion test in number of impacts.

A clear improvement in the adhesion properties is illustrated in the results reported in Table 5.

What is claimed is:

1. A process for forming a printed image comprising the steps of:

i) heating a solid phase change ink and printing a pattern of phase change ink on a transfer surface;

ii) transferring said pattern of phase change ink from said transfer surface to a receptor where said receptor comprises:

a 1–10 mil thick polyethylene terephthalate support; and a 1–15 mg/dm$^2$ receptor layer coated on said support wherein said receptor layer comprises:

a fibrous, branched silica with an average particle size of no more than 0.3 $\mu$m;

at least one polymer chosen from a set consisting of polyvinyl alcohol, polyacrylamide and gelatin; and said receptor layer comprises:

92–97% by weight of said silica; and

3–18% by weight of said polymer; and iii) fixing said pattern of phase change ink to said receptor to form a solid image.

2. The process for forming a printed image of claim 1 comprising no more than 10 mg/dm$^2$ of said receptor layer coated on said support.

3. The process for forming a printed image of claim 1 comprising the steps of:

i) heating said solid phase change ink to form said pattern of phase change ink;

ii) applying said pattern of phase change ink to said transfer surface;

iii) cooling said pattern of phase change ink on said transfer surface;

iv) transferring said pattern of phase change ink to said receptor; and v) fixing said pattern of phase change ink to said receptor to form said solid image.

4. A phase change ink recording media comprising:

a 1–10 mil thick polyethylene terephthalate support; and a 1–15 mg/dm$^2$ receptor layer coated on said support wherein said receptor layer comprises:

a fibrous, branched silica with an average particle size of no more than 0.3 $\mu$m;

at least one polymer chosen from a set consisting of polyvinyl alcohol, polyacrylamide and gelatin; and said receptor layer comprises:

92–97% by weight of said silica; and

3–18% by weight of said polymer; and a pattern of phase change ink on said receptor layer.

5. The phase change ink recording media of claim 4 comprising no more than 10 mg/dm$^2$ of said receptor layer on said support.

* * * * *